US008790089B2

(12) United States Patent
Moody et al.

(10) Patent No.: US 8,790,089 B2
(45) Date of Patent: Jul. 29, 2014

(54) COMPRESSOR SPEED CONTROL SYSTEM FOR BEARING RELIABILITY

(75) Inventors: Bruce A. Moody, Kingsport, TN (US); Eugene K. Chumley, Abingdon, VA (US); Jerry D. Edwards, Bristol, TN (US); Tim M. Wampler, Bluff City, TN (US); John W. Tolbert, Jr., Bristol, TN (US)

(73) Assignee: Bristol Compressors International, Inc., Bristol, VA (US)

( * ) Notice: Subject to any disclaimer, the term of this patent is extended or adjusted under 35 U.S.C. 154(b) by 309 days.

(21) Appl. No.: 12/494,020

(22) Filed: Jun. 29, 2009

(65) Prior Publication Data

US 2009/0324426 A1 Dec. 31, 2009

Related U.S. Application Data

(60) Provisional application No. 61/076,676, filed on Jun. 29, 2008, provisional application No. 61/076,675, filed on Jun. 29, 2008.

(51) Int. Cl.
*F04B 49/10* (2006.01)

(52) U.S. Cl.
USPC ..... 417/13; 417/53; 418/6.16

(58) Field of Classification Search
USPC ..... 417/13, 14, 22, 42, 44.1, 44.11, 45, 53; 418/6.16, 6.18
See application file for complete search history.

(56) References Cited

U.S. PATENT DOCUMENTS 2,219,199 A * 10/1940 Renner ..... 417/13
2,390,650 A 12/1945 Hollatz et al.
3,261,172 A 7/1966 Grant
3,388,559 A 6/1968 Johnson
3,411,313 A 11/1968 Brown et al.
3,874,187 A 4/1975 Anderson
3,903,710 A 9/1975 Quatman
4,045,973 A 9/1977 Anderson et al.
4,047,242 A 9/1977 Jakob et al.
4,475,358 A 10/1984 Seifert et al.
4,487,028 A 12/1984 Foye
4,514,989 A 5/1985 Mount
4,577,471 A 3/1986 Meckler
4,616,693 A 10/1986 Dietzsch et al.
4,709,560 A 12/1987 Voorhis et al.
4,720,981 A 1/1988 Helt et al.
4,891,953 A 1/1990 Isono (Continued)

FOREIGN PATENT DOCUMENTS

CN 2401835 U 10/2000
DE 4338939 C1 2/1995

(Continued)

*Primary Examiner* — Devon Kramer
*Assistant Examiner* — Amene Bayou
(74) *Attorney, Agent, or Firm* — McNees Wallace & Nurick LLC

(57) ABSTRACT

A system and method is provided for controlling the speed of the compressor to ensure adequate lubrication oil is provided to the components of the compressor. During operation of a capacity control program for the compressor, a preselected operating parameter of the compressor or motor drive is measured. The measured preselected operating parameter is compared to a preselected range for the operating parameter. If the measured preselected operating parameter is not within the preselected range, the output frequency of the capacity control program can be increased to provide proper lubrication for the components of the compressor.

17 Claims, 7 Drawing Sheets

(56) References Cited

U.S. PATENT DOCUMENTS

| | | | | |
|---|---|---|---|---|
| 4,895,005 | A | 1/1990 | Norbeck et al. | |
| 4,951,475 | A | 8/1990 | Alsenz | |
| 4,965,658 | A | 10/1990 | Norbeck et al. | |
| 5,012,656 | A | 5/1991 | Tamura | |
| 5,025,638 | A | 6/1991 | Yamagishi et al. | |
| 5,044,167 | A | 9/1991 | Champagne | |
| 5,052,186 | A | 10/1991 | Dudley et al. | |
| 5,062,276 | A | 11/1991 | Dudley | |
| 5,062,277 | A | 11/1991 | Heitmann et al. | |
| 5,066,197 | A * | 11/1991 | Champagne | 417/18 |
| 5,081,846 | A | 1/1992 | Dudley et al. | |
| 5,088,297 | A * | 2/1992 | Maruyama et al. | 62/228.4 |
| 5,107,685 | A | 4/1992 | Kobayashi | |
| 5,144,812 | A | 9/1992 | Mills, Jr. et al. | |
| 5,177,972 | A | 1/1993 | Sillato et al. | |
| 5,182,915 | A * | 2/1993 | Iida et al. | 62/89 |
| 5,220,809 | A | 6/1993 | Voss | |
| 5,263,335 | A | 11/1993 | Isono et al. | |
| 5,285,646 | A | 2/1994 | TaeDuk | |
| 5,303,561 | A | 4/1994 | Bahel et al. | |
| 5,315,376 | A | 5/1994 | Wada et al. | |
| 5,323,619 | A | 6/1994 | Kim | |
| 5,350,039 | A | 9/1994 | Voss et al. | |
| 5,475,985 | A | 12/1995 | Heinrichs et al. | |
| 5,533,352 | A | 7/1996 | Bahel et al. | |
| 5,546,073 | A | 8/1996 | Duff et al. | |
| 5,553,997 | A | 9/1996 | Goshaw et al. | |
| 5,568,732 | A | 10/1996 | Isshiki et al. | |
| 5,651,260 | A | 7/1997 | Goto et al. | |
| 5,671,607 | A | 9/1997 | Clemens et al. | |
| 5,729,995 | A | 3/1998 | Tajima | |
| 5,752,385 | A | 5/1998 | Nelson | |
| 5,764,011 | A | 6/1998 | Nakae et al. | |
| 5,765,994 | A * | 6/1998 | Barbier | 417/12 |
| 5,826,643 | A | 10/1998 | Galyon et al. | |
| 6,034,872 | A | 3/2000 | Chrysler et al. | |
| 6,041,609 | A | 3/2000 | Hornsleth et al. | |
| 6,070,110 | A | 5/2000 | Shah et al. | |
| 6,116,040 | A | 9/2000 | Stark | |
| 6,172,476 | B1 | 1/2001 | Tolbert, Jr. et al. | |
| 6,237,420 | B1 * | 5/2001 | Rowlette et al. | 73/714 |
| 6,330,153 | B1 | 12/2001 | Ketonen et al. | |
| 6,353,303 | B1 | 3/2002 | Ramachandran et al. | |
| 6,363,732 | B1 | 4/2002 | Bluhm | |
| 6,375,563 | B1 | 4/2002 | Colter | |
| 6,384,563 | B1 | 5/2002 | Someya | |
| 6,434,003 | B1 | 8/2002 | Roy et al. | |
| 6,434,960 | B1 | 8/2002 | Rousseau | |
| 6,511,295 | B2 | 1/2003 | Suitou et al. | |
| 6,523,361 | B2 | 2/2003 | Higashiyama | |
| 6,524,082 | B2 | 2/2003 | Morita et al. | |
| 6,560,980 | B2 | 5/2003 | Gustafson et al. | |
| 6,560,984 | B2 | 5/2003 | Bellet | |
| 6,604,372 | B2 | 8/2003 | Baumert et al. | |
| 6,639,798 | B1 | 10/2003 | Jeter et al. | |
| 6,663,358 | B2 | 12/2003 | Loprete et al. | |
| 6,675,590 | B2 | 1/2004 | Aarestrup | |
| 6,688,124 | B1 | 2/2004 | Stark et al. | |
| 6,704,202 | B1 | 3/2004 | Hamaoka et al. | |
| 6,808,372 | B2 | 10/2004 | Makino et al. | |
| 6,817,198 | B2 | 11/2004 | Wilson et al. | |
| 6,826,923 | B2 | 12/2004 | Nakano et al. | |
| 6,829,904 | B2 | 12/2004 | Roh et al. | |
| 6,874,329 | B2 | 4/2005 | Stark et al. | |
| 6,886,354 | B2 | 5/2005 | Dudley | |
| 7,164,242 | B2 | 1/2007 | Federman et al. | |
| 7,628,028 | B2 | 12/2009 | Tolbert, Jr. et al. | |
| 7,878,006 | B2 | 2/2011 | Pham | |
| 2001/0000880 | A1 | 5/2001 | Chu et al. | |
| 2001/0017039 | A1 | 8/2001 | Weimer | |
| 2002/0043074 | A1 | 4/2002 | Ott et al. | |
| 2002/0108384 | A1 | 8/2002 | Higashiyama | |
| 2003/0089121 | A1 | 5/2003 | Wilson et al. | |
| 2003/0205052 | A1 | 11/2003 | Kim et al. | |
| 2004/0003610 | A1 | 1/2004 | So et al. | |
| 2004/0055322 | A1 | 3/2004 | Monfarad | |
| 2004/0065095 | A1 | 4/2004 | Osborne et al. | |
| 2004/0139112 | A1 | 7/2004 | Wickham et al. | |
| 2004/0163403 | A1 | 8/2004 | Monfarad | |
| 2004/0174650 | A1 | 9/2004 | Wyatt et al. | |
| 2004/0194485 | A1 | 10/2004 | Dudley | |
| 2004/0237551 | A1 | 12/2004 | Schwarz et al. | |
| 2004/0237554 | A1 | 12/2004 | Stark et al. | |
| 2004/0261441 | A1 | 12/2004 | Turner et al. | |
| 2005/0076665 | A1 | 4/2005 | Pruitt | |
| 2005/0083630 | A1 | 4/2005 | Jun et al. | |
| 2005/0086959 | A1 | 4/2005 | Wilson et al. | |
| 2005/0100449 | A1 | 5/2005 | Hahn et al. | |
| 2005/0247073 | A1 | 11/2005 | Hikawa et al. | |
| 2006/0010891 | A1 | 1/2006 | Rayburn | |
| 2007/0022765 | A1 | 2/2007 | Lifson et al. | |
| 2007/0095081 | A1 | 5/2007 | Ootori et al. | |
| 2007/0256432 | A1 * | 11/2007 | Zugibe et al. | 62/115 |
| 2008/0041081 | A1 | 2/2008 | Tolbert | |
| 2009/0090118 | A1 * | 4/2009 | Pham et al. | 62/228.5 |
| 2009/0266091 | A1 | 10/2009 | Tolbert, Jr. | |
| 2009/0324427 | A1 | 12/2009 | Moody et al. | |
| 2009/0324428 | A1 | 12/2009 | Tolbert, Jr. et al. | |

FOREIGN PATENT DOCUMENTS

| | | | |
|---|---|---|---|
| EP | 0196863 | A1 | 10/1986 |
| EP | 0376498 | A1 | 7/1990 |
| EP | 0933603 | A1 | 8/1999 |
| EP | 1260774 | A2 | 11/2002 |
| EP | 1164035 | B1 | 8/2004 |
| JP | 58127038 | A | 7/1983 |
| JP | 6229853 | A | 2/1987 |
| JP | 1296038 | A | 11/1989 |
| JP | 4338670 | A | 11/1992 |
| JP | 6213498 | A | 8/1994 |
| JP | 814709 | A | 1/1996 |
| JP | 8145405 | A | 6/1996 |
| JP | 2000111216 | A | 4/2000 |
| JP | 2001163038 | A | 6/2001 |
| JP | 2003214659 | A | 7/2003 |
| JP | 2004219031 | A | 8/2004 |
| JP | 2004325023 | A | 11/2004 |
| JP | 2006343095 | A | 12/2006 |
| WO | 9411212 | A1 | 5/1994 |
| WO | 9815790 | A1 | 4/1998 |
| WO | 0022358 | A1 | 4/2000 |
| WO | 0078111 | A1 | 12/2000 |

* cited by examiner

COMPRESSOR SPEED CONTROL SYSTEM FOR BEARING RELIABILITY

CROSS REFERENCE TO RELATED APPLICATIONS

This application claims the benefit of U.S. Provisional Application 61/076,676, filed Jun. 29, 2008 and U.S. Provisional Application 61/076,675, filed Jun. 29, 2008.

BACKGROUND

The application generally relates to a speed control system for a compressor. The application relates more specifically to a speed control system for a compressor that can provide for adequate lubrication of the compressor bearings.

In certain compressors, the amount of lubrication oil that is provided to the bearings and other components of the compressor is related to the speed of the compressor, which is directly related to the frequency of current and voltage provided to the motor. In other words, the compressor receives more lubrication oil when operated at higher speeds (corresponding to higher voltage and current frequencies) and less lubrication oil when operated at lower speeds (corresponding to lower voltage and current frequencies). Typically, when the compressors are operated at lower speeds, the load on the compressor is not high and thus the corresponding requirement for lubrication oil is not high. However, when the compressor is operated at a lower speed and the load on the compressor increases, such as when the outdoor ambient temperature increases, the amount of lubrication oil provided by the lower speed operation may not provide enough protection for the compressor bearings.

Therefore what is needed is a control system for a compressor that can operate the compressor at an appropriate speed to provide a proper lubrication oil supply for the bearings and other components of the compressor.

SUMMARY

The present application relates to a method of determining adequate lubrication in a compressor. The method includes measuring an operating parameter associated with the compressor and selecting a predetermined range of values for the operating parameter based on a speed of the compressor. The predetermined range of values being bounded by an upper value and a lower value, and the predetermined range of values corresponds to the compressor having adequate lubrication. The method also includes comparing the measured operating parameter to the predetermined range of values and adjusting the speed of the compressor to provide additional lubrication oil to the components of the compressor in response to the measured operating parameter being greater than the upper value or less than the lower value.

The present application further relates to a system having a compressor, a motor drive configured to receive power from an AC power source and to provide power to the compressor, a first sensor to measure a value representative of an operating parameter of one of the motor drive or the compressor, and a controller to control operation of the motor drive. The controller includes an interface to receive the value representative of an operating parameter and a processor to process the value representative of an operating parameter to determine a need for additional lubrication in the compressor and to adjust the output frequency of the motor drive in response to the determination of the need for additional lubrication.

The present application also relates to a method of providing adequate lubrication to a compressor. The method includes measuring a current of a motor drive powering the compressor and selecting a predetermined range of values for the current of the motor drive based on a speed of the compressor. The predetermined range of values is bounded by an upper value and a lower value, and the predetermined range of values corresponds to the compressor having adequate lubrication. The method also includes comparing the measured current to the predetermined range of values and increasing the output frequency of the motor drive to provide more lubrication oil to the components of the compressor in response to the measured current being greater than the upper value.

One advantage of the present application is that the increase in the speed of the compressor under higher part load conditions can improve bearing performance by increasing the film thickness in the bearing.

DETAILED DESCRIPTION OF THE EXEMPLARY EMBODIMENTS

Figure 1:
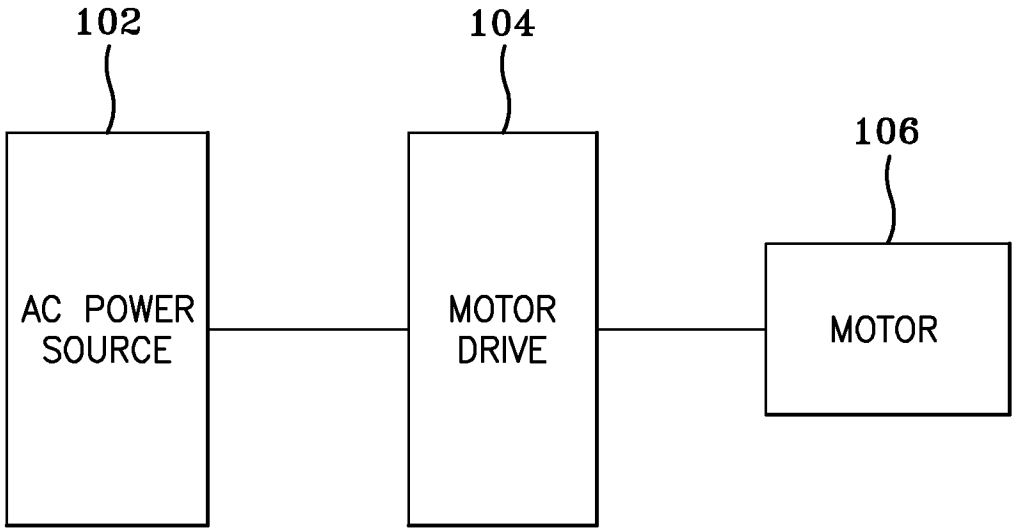
FIG. 1 schematically shows an exemplary embodiment of a system for providing power to a motor.

FIG. 1 shows an embodiment of a system for providing power to a motor. An AC power source 102 supplies electrical power to a motor drive 104, which provides power to a motor 106. The motor 106 can be used to power a motor driven component, e.g., a compressor, fan, or pump, of a vapor compression system (see generally, FIGS. 3 and 4). The AC power source 102 provides single phase or multi-phase (e.g., three phase), fixed voltage, and fixed frequency AC power to the motor drive 104. The motor drive 104 can accommodate virtually any AC power source 102. In an exemplary embodiment, the AC power source 102 can supply an AC voltage or line voltage of between about 180 V to about 600 V, such as 187 V, 208 V, 220 V, 230 V, 380 V, 415 V, 460 V, 575 V or 600 V, at a line frequency of 50 Hz or 60 Hz to the motor drive 104.

The motor drive 104 can be a variable speed drive (VSD) or variable frequency drive (VFD) that receives AC power having a particular fixed line voltage and fixed line frequency from the AC power source 102 and provides power to the motor 106 at a preselected voltage and preselected frequency (including providing a preselected voltage greater than the fixed line voltage and/or providing a preselected frequency greater than the fixed line frequency), both of which can be varied to satisfy particular requirements. Alternatively, the motor drive 104 can be a "stepped" frequency drive that can provide a predetermined number of discrete output frequencies and voltages, i.e., two or more, to the motor 106.

Figure 2:
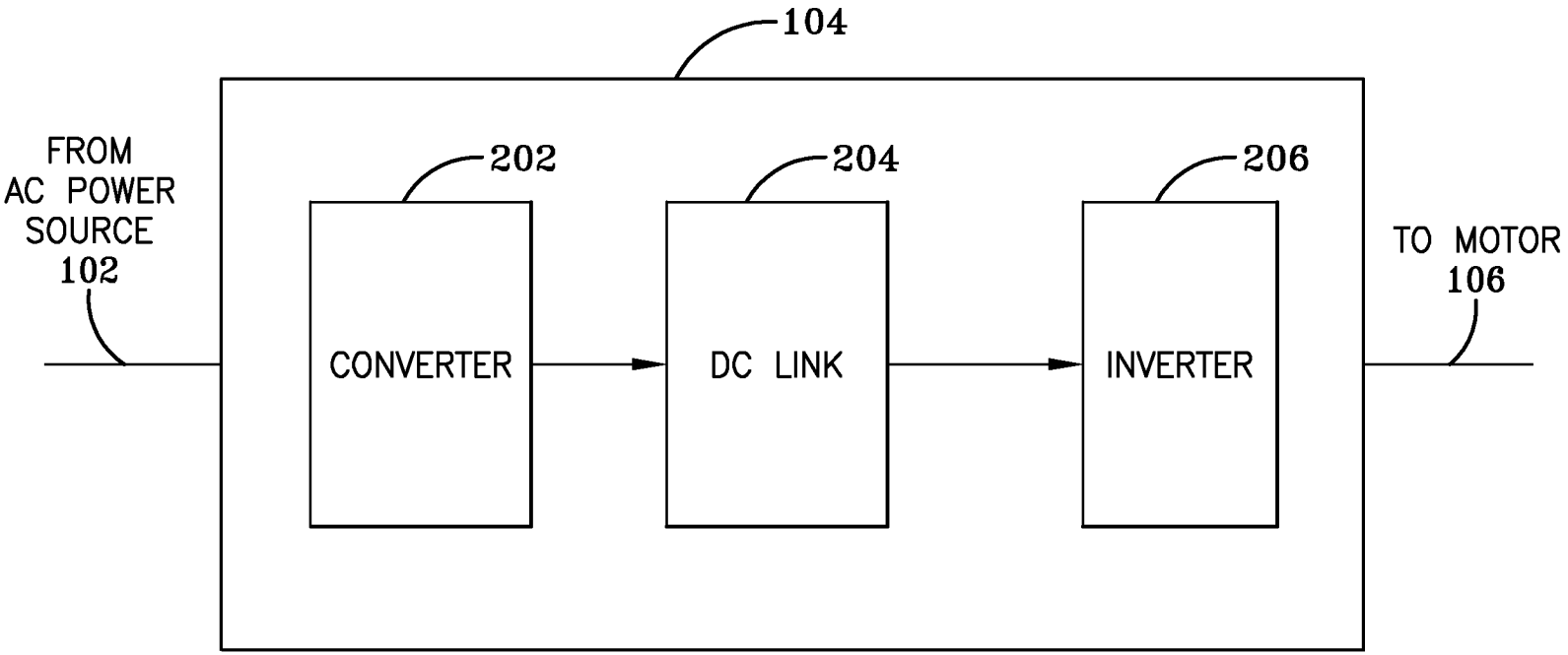
FIG. 2 schematically shows an exemplary embodiment of a motor drive.

FIG. 2 shows one embodiment of a motor drive 104. The motor drive 104 can have three components or stages: a converter or rectifier 202, a DC link or regulator 204 and an inverter 206. The converter 202 converts the fixed line frequency, fixed line voltage AC power from the AC power source 102 into DC power. The DC link 204 filters the DC power from the converter 202 and provides energy storage components. The DC link 204 can include one or more capacitors and/or inductors, which are passive devices that exhibit high reliability rates and very low failure rates. The inverter 206 converts the DC power from the DC link 204 into variable frequency, variable voltage power for the motor 106. Furthermore, in other exemplary embodiments, the converter 202, DC link 204 and inverter 206 of the motor drive 104 can incorporate several different components and/or configurations so long as the converter 202, DC link 204 and inverter 206 of the motor drive 104 can provide the motor 106 with appropriate output voltages and frequencies.

In an exemplary embodiment, the motor 106 can operate from a voltage that is less than the fixed voltage provided by the AC power source 102 and output by the motor drive 104. By operating at a voltage that is less than the fixed AC voltage, the motor 106 is able to continue operation during times when the fixed input voltage to the motor drive 104 fluctuates.

Figure 3:
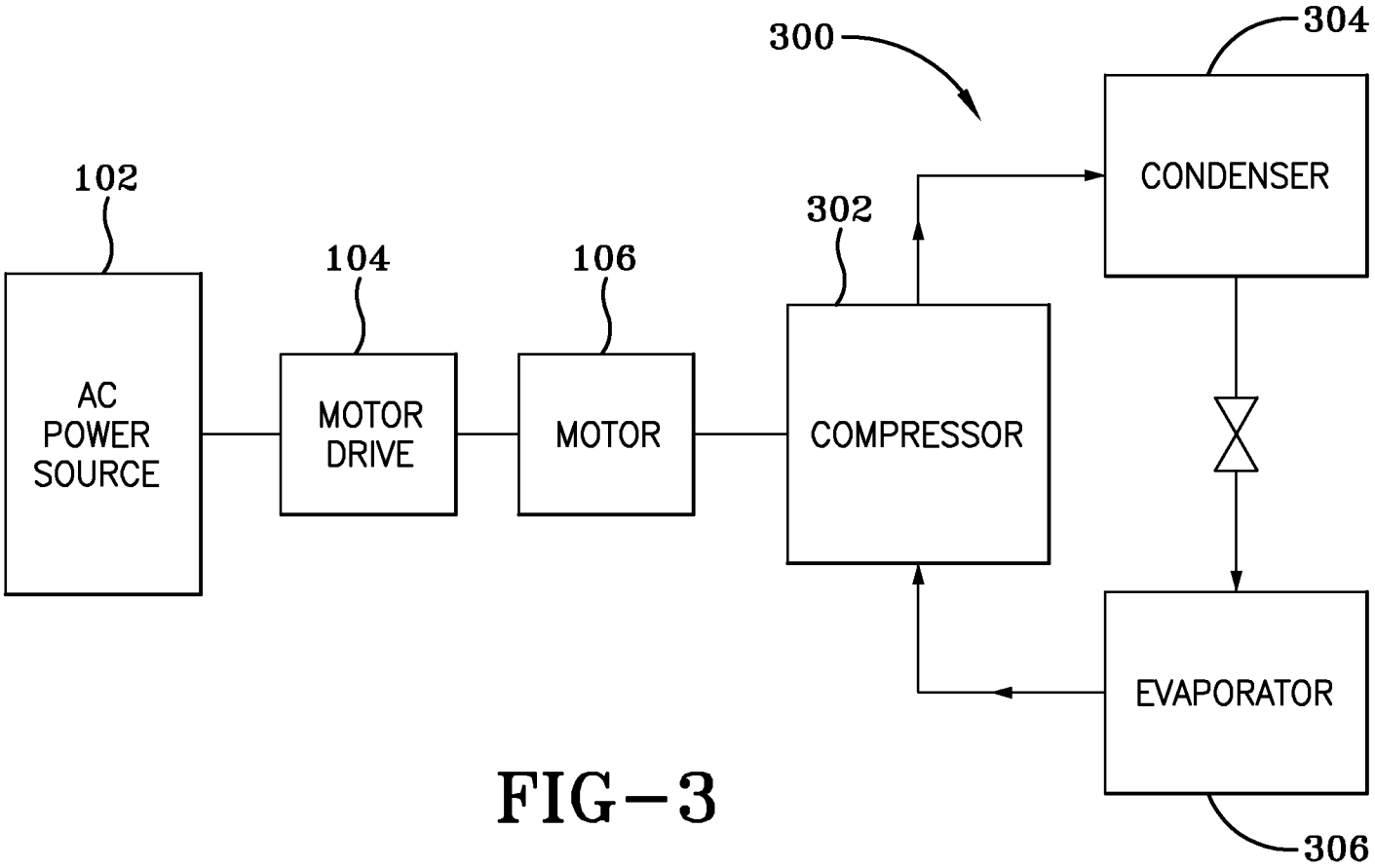
FIG. 3 schematically shows an exemplary embodiment of a vapor compression system.
Figure 4:
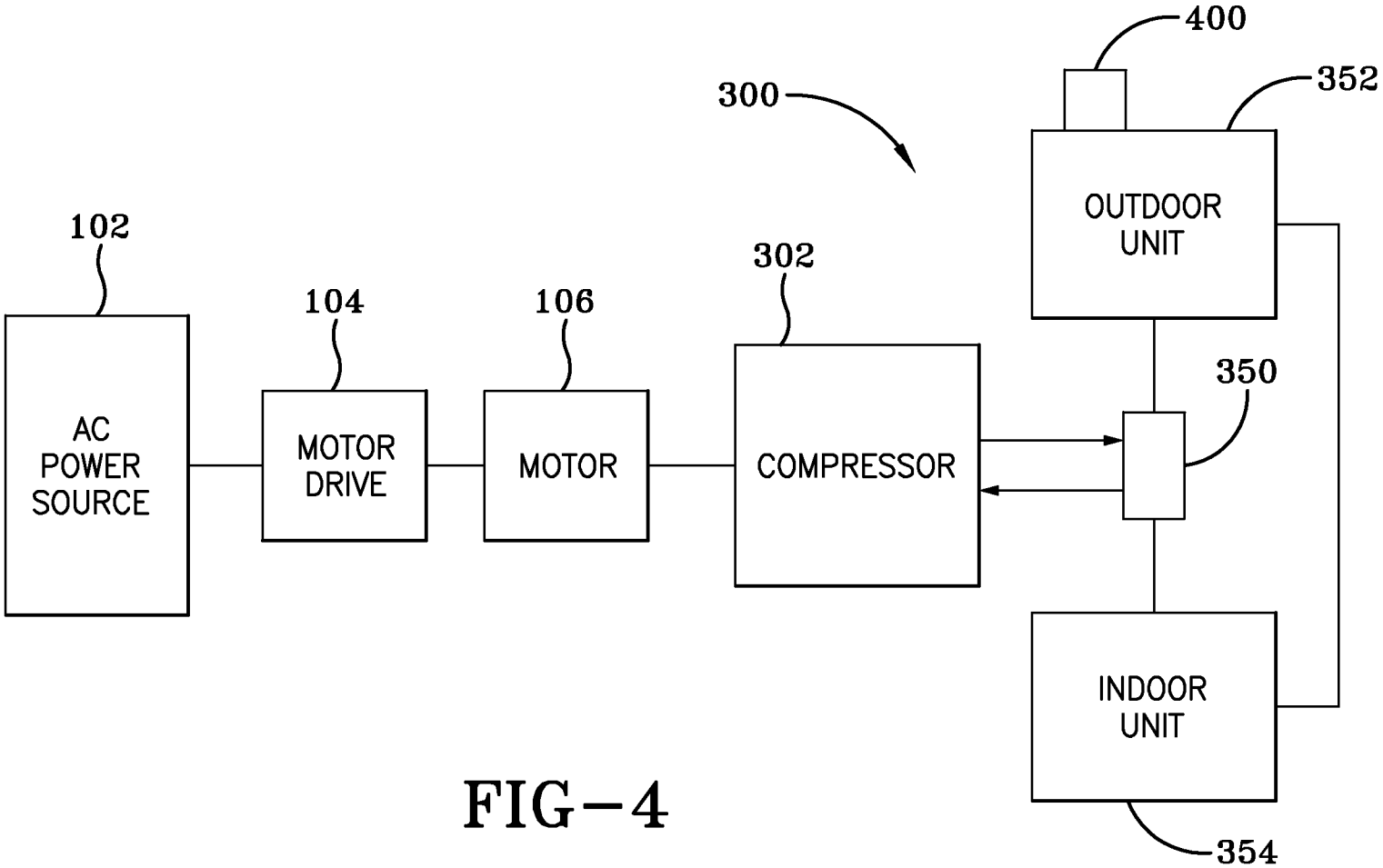
FIG. 4 schematically shows another exemplary embodiment of a vapor compression system.

As shown in FIGS. 3 and 4, a vapor compression system 300 includes a compressor 302, a condenser 304, and an evaporator 306 (see FIG. 3) or a compressor 302, a reversing valve 350, an indoor unit 354 and an outdoor unit 352 (see FIG. 4). The vapor compression system can be included in a heating, ventilation and air conditioning (HVAC) system, refrigeration system, chilled liquid system or other suitable type of system. Some examples of refrigerants that may be used in vapor compression system 300 are hydrofluorocarbon (HFC) based refrigerants, e.g., R-410A, R-407C, R-404A, R-134a or any other suitable type of refrigerant. In addition, a temperature sensor 400 can be used to measure the outdoor ambient temperature.

The vapor compression system 300 can be operated as an air conditioning system, where the evaporator 306 is located inside a structure or indoors, i.e., the evaporator is part of indoor unit 354, to provide cooling to the air in the structure and the condenser 304 is located outside a structure or outdoors, i.e., the condenser is part of outdoor unit 352, to discharge heat to the outdoor air. The vapor compression system 300 can also be operated as a heat pump system, i.e., a system that can provide both heating and cooling to the air in the structure, with the inclusion of the reversing valve 350 to control and direct the flow of refrigerant from the compressor 302. When the heat pump system is operated in an air conditioning mode, the reversing valve 350 is controlled to provide for refrigerant flow as described above for an air conditioning system. However, when the heat pump system is operated in a heating mode, the reversing valve 350 is controlled to provide for the flow of refrigerant in the opposite direction from the air conditioning mode. When operating in the heating mode, the condenser 304 is located inside a structure or indoors, i.e., the condenser is part of indoor unit 354, to provide heating to the air in the structure and the evaporator 306 is located outside a structure or outdoors, i.e., the evaporator is part of outdoor unit 352, to absorb heat from the outdoor air.

Referring back to the operation of the system 300, whether operated as a heat pump or as an air conditioner, the compressor 302 is driven by the motor 106 that is powered by motor drive 104. The motor drive 104 receives AC power having a particular fixed line voltage and fixed line frequency from AC power source 102 and provides power to the motor 106. The motor 106 used in the system 300 can be any suitable type of motor that can be powered by a motor drive 104. The motor 106 can be any suitable type of motor including, but not limited to, an induction motor, a switched reluctance (SR) motor, or an electronically commutated permanent magnet motor (ECM).

Referring back to FIGS. 3 and 4, the compressor 302 compresses a refrigerant vapor and delivers the vapor to the condenser 304 through a discharge line (and the reversing valve 350 if configured as a heat pump). The compressor 302 can be any suitable type of compressor including, but not limited to, a reciprocating compressor, rotary compressor, screw compressor, centrifugal compressor, scroll compressor, linear compressor or turbine compressor. The refrigerant vapor delivered by the compressor 302 to the condenser 304 enters into a heat exchange relationship with a fluid, e.g., air or water, and undergoes a phase change to a refrigerant liquid as a result of the heat exchange relationship with the fluid. The condensed liquid refrigerant from the condenser 304 flows through an expansion device to the evaporator 306.

The condensed liquid refrigerant delivered to the evaporator 306 enters into a heat exchange relationship with a fluid, e.g., air or water, and undergoes a phase change to a refrigerant vapor as a result of the heat exchange relationship with the fluid. The vapor refrigerant in the evaporator 306 exits the evaporator 306 and returns to the compressor 302 by a suction line to complete the cycle (and the reversing valve arrangement 350 if configured as a heat pump). In other exemplary embodiments, any suitable configuration of the condenser 304 and the evaporator 306 can be used in the system 300, provided that the appropriate phase change of the refrigerant in the condenser 304 and evaporator 306 is obtained. For example, if air is used as the fluid to exchange heat with the refrigerant in the condenser or the evaporator, then one or more fans can be used to provide the necessary airflow through the condenser or evaporator. The motors for the one or more fans may be powered directly from the AC power source 102 or a motor drive, including motor drive 104.

Figure 5:
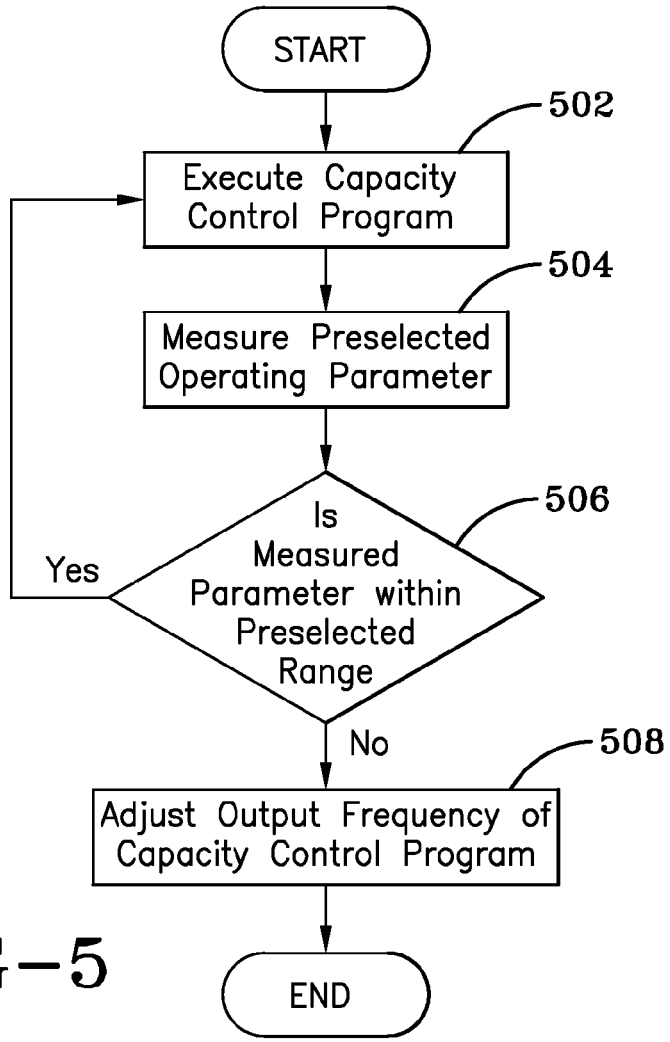
FIG. 5 shows an exemplary embodiment of a process for controlling the speed of the compressor to provide adequate lubrication to the compressor components.

FIG. 5 shows an embodiment of a process for controlling the speed of the compressor in an HVAC system to ensure that there is adequate lubrication oil for the compressor bearings and other components. The process begins with a controller (see e.g., FIG. 6) executing a capacity control program or algorithm to control the speed and/or output capacity of the compressor (step 502). The controller can be any suitable device used to control operation of the motor drive and the compressor. The controller can be incorporated into the motor drive used with the compressor, incorporated in a thermostat for an HVAC system that includes the compressor or positioned as a separate component from the motor drive and/or the thermostat. The controller can execute any suitable type of capacity control algorithm that can satisfy the requirements of the HVAC system.

Figure 7:
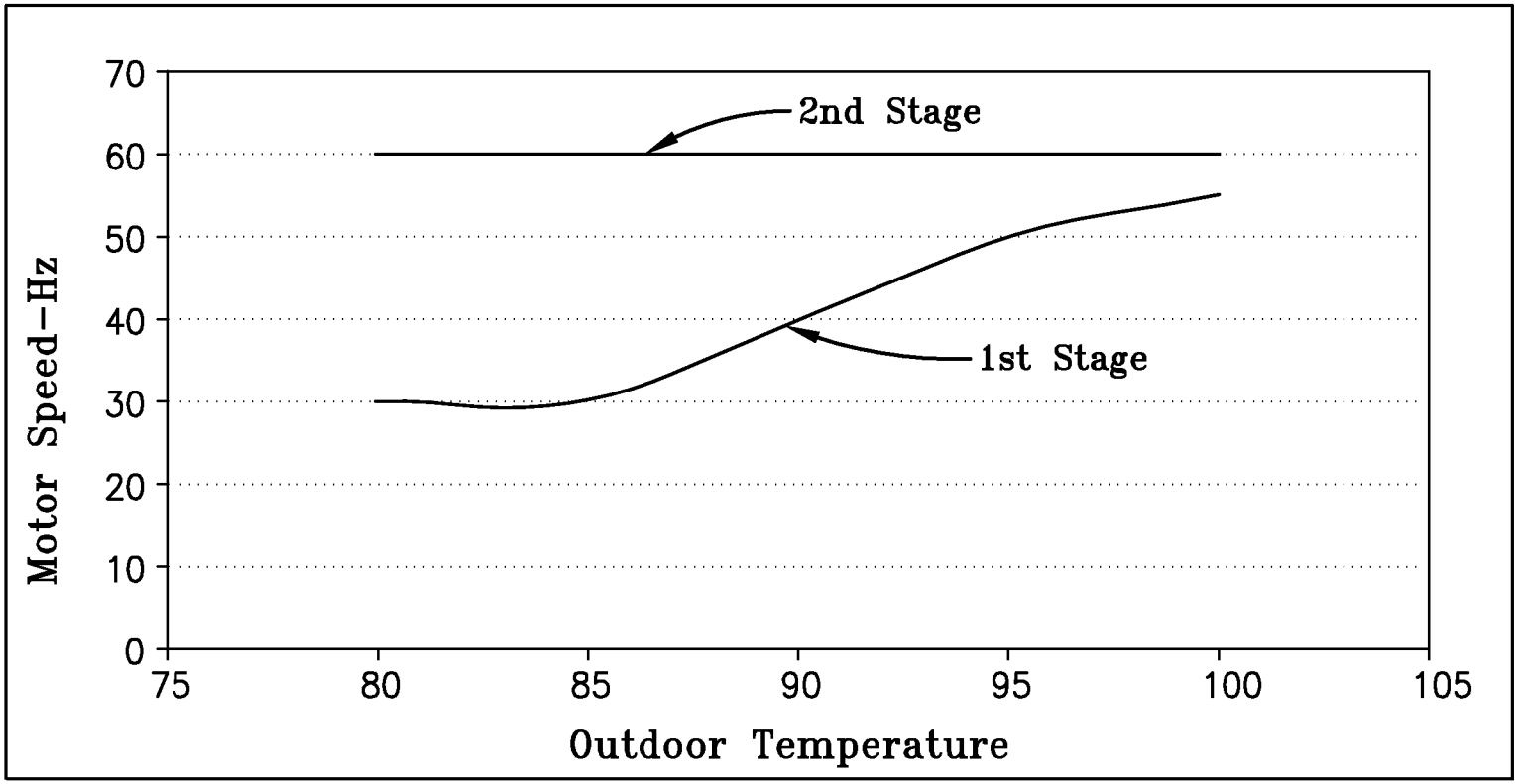
FIG. 7 shows an exemplary embodiment of a two-stage capacity control algorithm.

In an exemplary embodiment, the controller can execute a capacity control algorithm as shown in FIG. 7. The capacity control algorithm has two stages, a first or low stage that can be used for lower load conditions, and a second or high stage that can be used for higher load conditions. Each of the stages can control the output frequency of the motor drive to control the speed of the compressor. In the second or high stage of the capacity control algorithm, the motor drive outputs a constant frequency of 60 Hz. However, in the first or low stage, the capacity control algorithm can adjust the output frequency of the motor drive based on a measured outdoor ambient temperature. As shown in FIG. 7, during first stage operation, the output frequency of the motor drive can increase as the outdoor ambient temperature increases. The output frequency of the motor drive can increase in the first stage to respond to an increase in load conditions as a result of the increase in outdoor ambient temperature.

During operation of the capacity control algorithm, a preselected operating parameter of the compressor, the motor drive and/or the HVAC system can be measured (step 504). In an exemplary embodiment, the current of the motor drive can be measured. The measured current of the motor drive can be the output current provided to the motor, a DC bus current in the motor drive, an AC ripple current in the motor drive, the current provided to the motor drive by the AC power source or any combination of these currents. In another exemplary embodiment, the outdoor ambient temperature can be measured using a temperature sensor (see e.g., FIG. 4). In still another exemplary embodiment, both the current of the motor drive and the outdoor ambient temperature can be measured.

Figure 8:
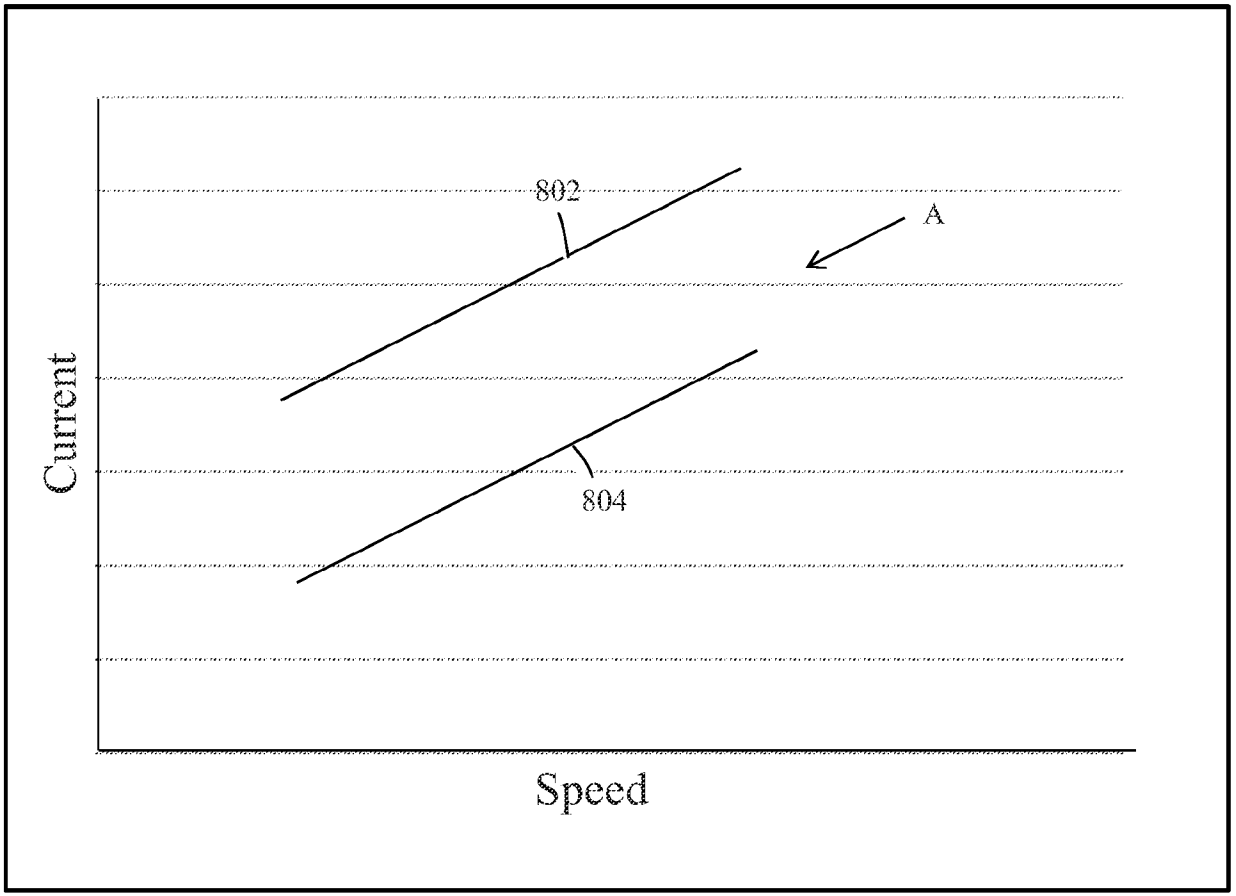
FIG. 8 shows an exemplary current range for a speed control process.

Next, the measured operating parameter is evaluated to determine if the measured operating parameter is within a preselected range that corresponds to the compressor having adequate lubrication for the compressor's current operating speed (step 506). FIG. 8 shows an exemplary preselected range for the motor drive current. In FIG. 8, the preselected range (A) for the motor drive current can have an upper limit for a corresponding motor speed and a lower limit for a corresponding motor speed. The upper limits for the motor drive current are defined by line 802 and the lower limits for the motor drive current are defined by line 804. Similar preselected ranges can be determined for the outdoor ambient temperature and any other operating parameter that is measured. In an exemplary embodiment, both motor drive current and the outdoor ambient temperature can be used to determine if there is adequate lubrication for the compressor bearings. As previously discussed, the motor drive current can be evaluated based on a preselected range for the motor drive current, except that the preselected range for the motor drive current can vary depending on the measured outdoor ambient temperature. If the measured operating parameter is within the preselected range, e.g., the measured current is between lines 802 and 804, then the process returns to the execution of the capacity control program (step 502).

However, if the measured operating parameter is outside the preselected range, e.g., the measured current is above line 802, then the process adjusts the output frequency of the capacity control program to adjust the output speed of the compressor. In one exemplary embodiment, the output frequency from the motor drive is increased by a predetermined amount, e.g., about 1 Hz to about 20 Hz. After the output frequency is adjusted, the capacity control program can resume operation at the adjusted frequency and repeat the process to determine if additional adjustments are necessary. Once the measured operating parameter remains in the preselected range for a predetermined period of time, the output frequency from the motor drive can be set to the output frequency set by the capacity control program.

Figure 6:
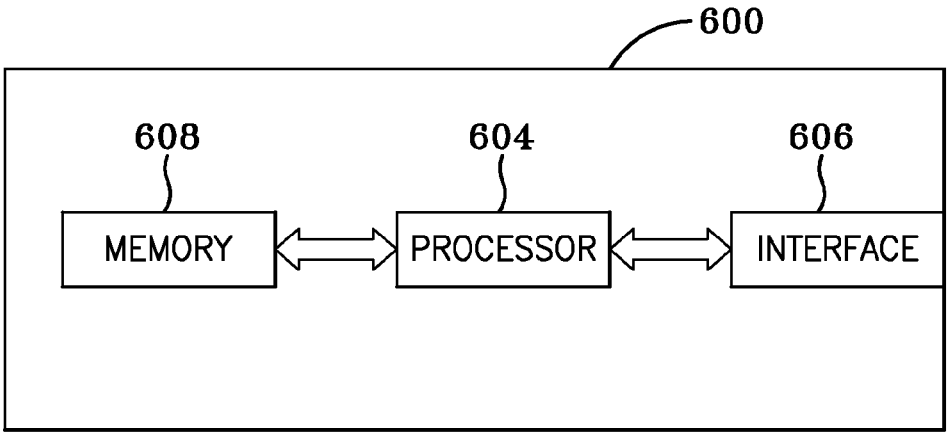
FIG. 6 schematically shows an exemplary embodiment of a controller.

FIG. 6 shows an embodiment of a controller that can be used to control the compressor and/or motor drive. The controller 600 can include a processor 604 that can communicate with an interface 606. The processor 604 can be any suitable type of microprocessor, processing unit, or integrated circuit. The interface 606 can be used to transmit and/or receive information, signals, data, control commands, etc. A memory device(s) 608 can communicate with the processor 604 and can be used to store the different preselected ranges, other control algorithms, system data, computer programs, software or other suitable types of electronic information.

Embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Also, two or more steps may be performed concurrently or with partial concurrence. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A method of determining adequate lubrication in a compressor comprising:

executing a capacity control algorithm, the capacity control algorithm being operable to control the compressor to operate at a predetermined speed;

measuring an operating parameter associated with the compressor;

selecting a predetermined range of values for the operating parameter from a plurality of predetermined ranges of values for the operating parameter based on the predetermined speed of the compressor, each predetermined range of values of the plurality of predetermined ranges of values being bounded by an upper value and a lower value, and each predetermined range of values of the plurality of predetermined ranges of values corresponding to the compressor having adequate lubrication for the corresponding predetermined speed;

comparing the measured operating parameter to the selected predetermined range of values; and overriding the capacity control algorithm to adjust the speed of the compressor to provide additional lubrication oil to at least one bearing of the compressor in response to the measured operating parameter being greater than the upper value or less than the lower value.

2. The method of claim 1 further comprises:

measuring an outdoor ambient temperature; and the selecting a predetermined range of values comprises selecting a predetermined range of values for the operating parameter from a plurality of predetermined ranges of values for the operating parameter based on the predetermined speed of the compressor and the measured outdoor ambient temperature.

3. The method of claim 1 further comprises:

providing a motor drive to power the compressor; and the adjusting the speed of the compressor comprises adjusting the output frequency provided by the motor drive to the compressor.

4. The method of claim 3 wherein the adjusting the output frequency comprises increasing the output frequency provided by the motor drive to the compressor by about 1 Hz to about 20 Hz.

5. The method of claim 3 wherein:

the measuring an operating parameter comprises measuring a current of the motor drive; and the selecting a predetermined range of values comprises selecting a predetermined range of values from a plurality of predetermined ranges of values for the measured motor drive current based on the speed of the compressor.

6. The method of claim 5 wherein the measuring a current of the motor drive comprises measuring at least one of an output current provided to the motor, a DC bus current in the motor drive, an AC ripple current in the motor drive, or a current provided to the motor drive by an AC power source.

7. The method of claim 1 further comprising repeating said measuring an operating parameter, said comparing the measured operating parameter to the selected predetermined range of values and said overriding the capacity control algorithm until the measured operating parameter is within the predetermined range of values.

8. The method of claim 7 further comprising resuming speed control of the compressor with the capacity control algorithm in response to the measured operating parameter being within the predetermined range values for a predetermined period of time.

9. A system comprising:

a compressor;

a motor drive configured to receive power from an AC power source and to provide power to the compressor;

a first sensor to measure a value representative of an operating parameter of one of the motor drive or the compressor; and a controller to control operation of the motor drive, the controller comprising:

an interface to receive the value representative of the operating parameter;

a non-transient tangible memory device storing a plurality of predetermined ranges of values for the operating parameter, each predetermined range of operating parameter values being bounded by an upper value and a lower value, and each predetermined range of operating parameter values corresponding to an output frequency of the motor drive;

a processor to execute a capacity control algorithm to set an output frequency of the motor drive, the processor being operable to compare the value representative of the operating parameter to a selected predetermined range of values for the operating parameter corresponding to the set output frequency of the motor drive to determine a need for additional lubrication in the compressor and to adjust the output frequency of the motor drive set by the capacity control algorithm in response to the determination of the need for additional lubrication.

10. The system of claim 9 further comprising:

a second sensor positioned to measure a value representative of the outdoor ambient temperature;

the interface is configured to receive the value representative of the outdoor ambient temperature; and the processor is configured to process the value representative of the operating parameter and the value representative of the outdoor ambient temperature to determine a need for additional lubrication in the compressor using a selected predetermined range of values corresponding to the set output frequency of the motor drive.

11. The system of claim 9 wherein the processor is configured to increase the output frequency of the motor drive by about 1 Hz to about 20 Hz in response to the determination of the need for additional lubrication.

12. The system of claim 9 wherein the first sensor is positioned to measure a current of the motor drive.

13. The system of claim 12 wherein the first sensor is positioned to measure at least one of an output current provided to the motor, a DC bus current in the motor drive, an AC ripple current in the motor drive, or a current provided to the motor drive by the AC power source.

14. A method of providing adequate lubrication to a compressor comprising:

measuring a current of a motor drive powering the compressor;

selecting a predetermined range of values for the current of the motor drive from a plurality of predetermined ranges of values for the current of the motor drive based on a predetermined speed of the compressor established by a capacity control algorithm, each predetermined range of values of the plurality of predetermined ranges of values being bounded by an upper value and a lower value, and each predetermined range of values of the plurality of predetermined ranges of values corresponding to the compressor having adequate lubrication for the corresponding predetermined speed;

comparing the measured current to the selected predetermined range of values; and increasing the output frequency of the motor drive to provide more lubrication oil to at least one bearing of the compressor in response to the measured current being greater than the upper value.

15. The method of claim 14 further comprises:

measuring an outdoor ambient temperature; and the selecting a predetermined range of values comprises selecting a predetermined range of values from a plurality of predetermined ranges of values for the current of the motor drive based on the predetermined speed of the compressor and the measured outdoor ambient temperature.

16. The method of claim 14 wherein the increasing the output frequency of the motor drive comprises increasing the output frequency of the motor drive by about 1 Hz to about 20 Hz.

17. The method of claim 14 wherein the measuring a current of the motor drive comprises measuring at least one of an output current provided to the motor, a DC bus current in the motor drive, an AC ripple current in the motor drive, or a current provided to the motor drive by an AC power source.

* * * * *